US006286162B1

(12) United States Patent
Huart

(10) Patent No.: US 6,286,162 B1
(45) Date of Patent: Sep. 11, 2001

(54) BEDDING ELEMENTS

(76) Inventor: Michele G. Huart, 78 chaussée de Namur, Sart-St-Laurent B-5070 (BE)

( * ) Notice: Subject to any disclaimer, the term of this patent is extended or adjusted under 35 U.S.C. 154(b) by 0 days.

(21) Appl. No.: 09/284,807

(22) PCT Filed: Oct. 20, 1997

(86) PCT No.: PCT/IB97/01315

§ 371 Date: Jun. 10, 1999

§ 102(e) Date: Jun. 10, 1999

(87) PCT Pub. No.: WO98/17156

PCT Pub. Date: Apr. 30, 1998

(30) Foreign Application Priority Data

Oct. 21, 1996 (BE) ..... 9600890

(51) Int. Cl.[7] ..... A47C 31/10
(52) U.S. Cl. ..... 5/482; 5/485; 5/497
(58) Field of Search ..... 5/482, 485, 497, 5/448

(56) References Cited

U.S. PATENT DOCUMENTS

| | | | | |
|---|---|---|---|---|
| 1,865,329 | * | 6/1932 | McHorter | 5/497 |
| 4,316,299 | * | 2/1982 | Friedman | 5/485 |
| 4,839,934 | * | 6/1989 | Rojas | 5/485 |
| 5,442,822 | * | 8/1995 | Diaz | 5/497 |
| 5,901,389 | * | 5/1999 | Manner | 5/497 |

* cited by examiner

*Primary Examiner*—Lynne H. Browne
*Assistant Examiner*—Fredrick Conley
(74) *Attorney, Agent, or Firm*—Pillsbury Winthrop LLP

(57) ABSTRACT

Cover for bedding element suitable for receiving at least one comforter comprising a first main piece of fabric and a seecond main piece of fabric joined together by their lateral borders and at least one holding device which in substance takes on the form of a rectangle parallelepiped open on one of its sides, and suitable for conforming in shape to an extremity of the mattress characterized in that said holding device is an integral part of the cover, and is formed by the first main piece of fabric and the second main piece of fabric, in such a way that the cover is reversible.

6 Claims, 8 Drawing Sheets

BEDDING ELEMENTS

This application is the national phase of international application PCT/IB97/01315 filed Oct. 20, 1997 which designated the U.S.

FIELD OF THE INVENTION

Description of the Related Art

This invention relates to bedding elements, and in particular the covers for these, especial comforter covers.

Different models of comforter covers are available on the market. Such covers comprise at least two pieces of fabric joined together by their lateral borders and by the front borders destined to be turned toward the head of the bed. Usually, the rear borders, destined to be turned toward the food of the bed, are left either completely or partially open, in order to be able to insert the comforter into the cover and to withdraw it therefrom with ease. The cover and the comforter are simply tucked under the mattress. The width of the cover (and the comforter) is often greater than that of the mattress. As time passes, because of the movements of the sleepers, on the one hand the comforter has a tendency to come out of the cover, and on the other hand the bed has a tendency to become undone.

Comforter covers can be found on the market, but whose open side is provided with a piece of fabric stitched smaller or attached differently to the free part from that of the two pieces of fabric destined to be turned toward the top of the bedding. It is then this piece of additional fabric which is tucked under the mattress. Such a cover is for example described in the patent application EP-A-0 026 968, and in the patents CH-A-202 811 and CH-A-214326. This category of cover allows the comforter to come out less easily, but it is not held on the bed satisfactorily either.

In the applications GB-A-2 023 419 and GB-A-2 031 504 for example, comforters provided with different pieces of fabric destined to be tucked under the mattress have also been put forward.

Other models are also known, in which it is each of the two main pieces of fabric which take on a particular form as they extend, in the middle of their rear borders, by narrow pieces of fabric themselves stitched to one another, and both of which are tucked under the mattress. This type of comforter cover is more satisfactory, but nevertheless imperfect for the sleeper.

Indeed, as in all the other known types, the bed, in the long run, has a tendency to undo, and the comforter furthermore has a tendency to move inside the cover.

There has been proposed, for example in U.S. Pat. No. 4,316,299, a non reversible comforter cover for which one end acts as a holding device, in substance taking on the form of a rectangle parallelepiped, and suitable for conforming in shape to an extremity of the mattress In the document GB-A-2 191 088, there is proposed on the other hand a comforter cover which is reversible in principle, comprising for this purpose several additional pieces of fabric.

Except if there is used a complex and unaesthetic structure requiring numerous handling for the manufacturing and the maintenance, as is the case for the cover of the document GB-A-2191088, none of the comforter covers mentioned above is reversible.

The purpose of the invention is to solve this problem simply and efficiently.

BRIEF SUMMARY OF THE INVENTION

The purpose of the invention is a bedding element cover suitable for receiving at least one comforter comprising a first main piece of fabric and a second main piece of fabric joined together by their lateral borders. It comprises at least one holding device which in substance takes on the form of a rectangle parallelepiped open on one of its sides, and suitable for conforming in shape to an extremity of the mattress. The holding device is an integral part of the comforter cover and is formed by the main first piece of fabric and the second main piece of fabric, in such a way that the cover is reversible.

In that way, the problem forming the base of the invention is solved simply and efficiently.

Advantageously, a holding device comprises on each of its sides a first assembly area and a second assembly area.

Preferably, the assembly areas consist of borders of the rectangle parallelepiped. They can be joined by stitching.

These assembly areas can be implemented from elements selected from among the borders of the pieces of fabric and the internal fabric areas.

In various embodiments, the covers according to the invention comprise at least two compartments each suitable for receiving a comforter. They can comprise three.

A cover according to the invention can also comprise at least one intermediate piece of fabric placed between the two main pieces of fabric, this intermediate piece having dimensions such that it is suitable for being superposed on the two other pieces by defining with the main pieces two compartments each suitable for receiving a comforter.

A holding device for a cover according to the invention can be suitable for conforming in shape to the foot or the head of a mattress.

Advantageously, the covers according to the invention can comprise elements suitable for enabling their attachment to a mattress. These are for example flaps of fabric.

The purpose of the invention is also a bedding element comprising a cover according to the invention and at least one padding element selected from among the comforters and the auxiliary mattresses. Such a bedding element is suitable for being utilized on a mattress, but also as a sleeping-bag.

In a particular embodiment, it can comprise a holding device suitable for conforming in shape to the head of a mattress when it is utilized on such a mattress, and suitable for receiving a pillow when it is utilized as a sleeping-bag.

The purpose of the invention is also holding devices for covers for bedding elements as specified above.

BRIEF DESCRIPTION OF THE DRAWINGS

The invention will be better understood by referring to the specification which follows of various embodiments, reference being made to the attached drawings, in which

FIGS. 1 and 2 represent a completely reversible cover 100 according to the invention, respectively prior to and after being made.

DETAILED DESCRIPTION OF THE INVENTION

Figure 2:
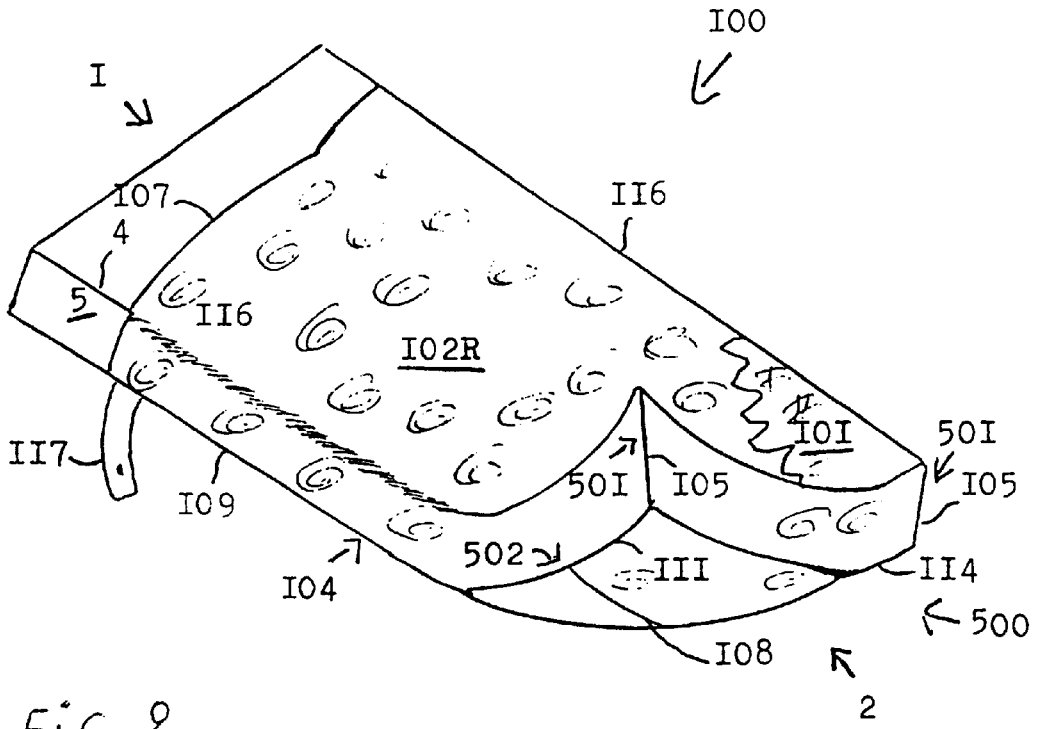
FIG. 2 represents a view in isometric projection with partial cut-away of this first embodiment of a reversible cover for a bedding element according to the invention, containing a comforter, and secured at the foot of a mattress.

The cover 100 is provided for receiving a comforter 101, visible in the cut-away made in FIG. 2. As can also be seen in this FIG. 2, the cover 100 can be utilized on a mattress 1, to the foot 2 of which it is then perfectly secured owing to its integrated holding device, indicated by the general reference 500, which will be described in greater detail in the remainder of the specification.

The first main piece of fabric 102 and the second main piece of fabric 103 are superposed in a manner such that their respective first lateral borders 104, their intermediate borders 105, their second lateral borders 106, as well as their front borders 107 and their rear borders 108 coincide.

They are joined one to the other, preferably stitched, by their first lateral borders 104 (bordering on its elevation the widest part of each of the pieces 102 and 103), their intermediate borders 105 and their second lateral borders 106 (bordering on its elevation the narrowest part of each of the pieces 102 and 103).

By convention, the front side of a piece of fabric is indicated by the letter R (for "recto") according to the reference figure given to the piece. Its reverse side is indicated in similar manner by the letter V (for "verso").

The assembly is effected in a manner such that, when the cover 100 is finished, the reverse sides 102V and 103V between which the comforter 101 will be inserted into the resulting compartment are classically turned one toward the other. It will be noted that in this case, a piece 102 has been represented embellished with decorated designs and a plain piece 103. In FIG. 2 a cover 100 according to the invention is represented with its side 102R turned outward; following a simple manipulation, it would nevertheless be possible to obtain a cover 100 with the same form having a plain appearance procured by the side 103R. The embodiment represented in FIGS. 1 and 2 is indeed completely reversible.

Generally, the comforter 101 utilized has a length and a width very slightly smaller than those of the part of the cover 100 determined by the first lateral borders 104, the intermediate borders 105, and the front borders 107 destined to be turned toward the head 3 of the mattress 1.

They are therefore positioned in such a manner that their angles are lodged in the angles respectively formed by the first lateral borders 104 and the front borders 107, and by these borders 104 and the intermediate borders 105, which contributes to its proper remaining in position.

Figure 1:
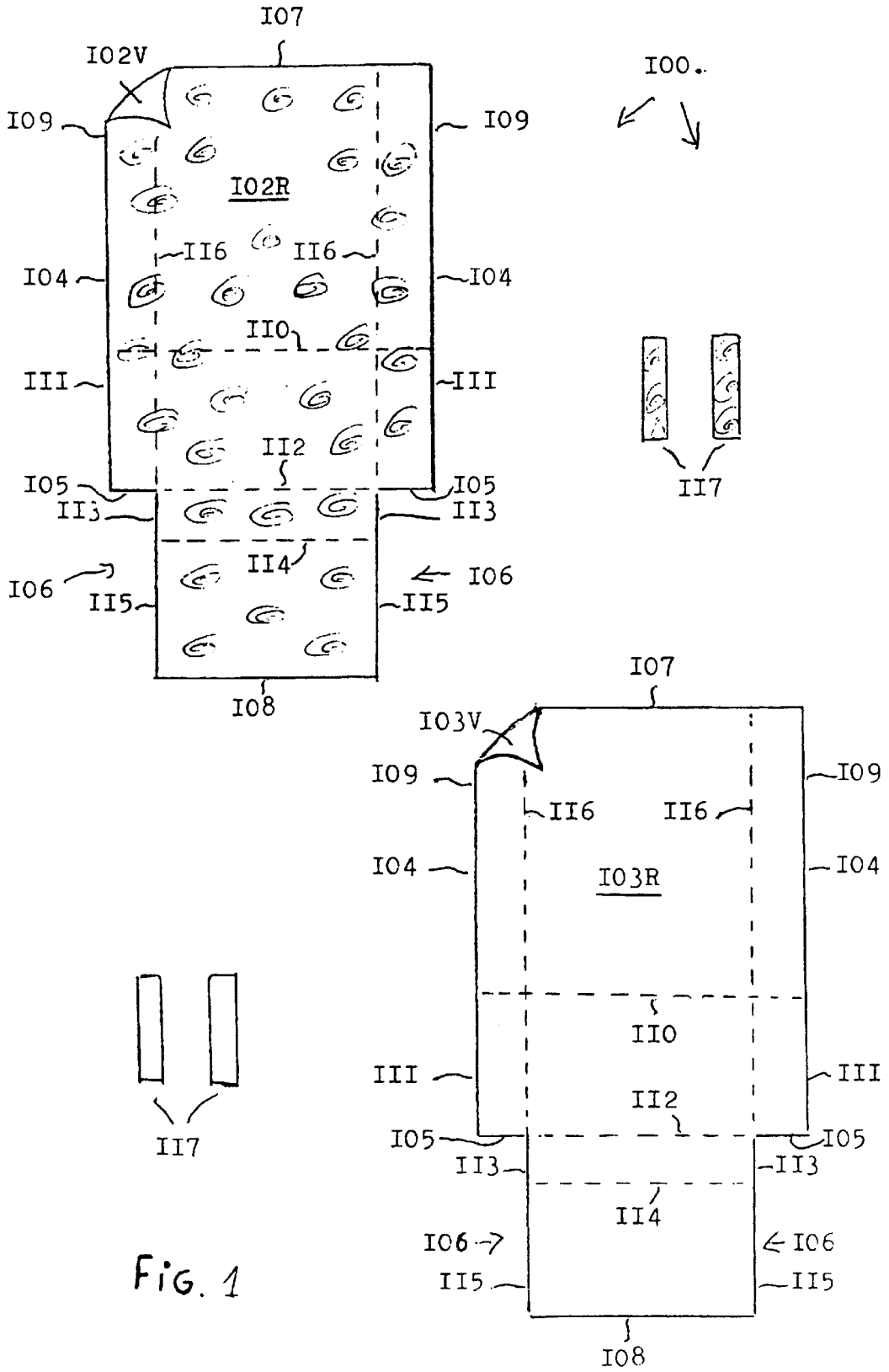
FIG. 1 represents a pattern consisting of different pieces of fabric utilized for implementing a first embodiment of a reversible cover for a bedding element according to the invention.

For ease, in FIG. 1 various lines are represented in horizontal dashed-dotted lines, and in vertical dashed-dotted lines, which to all intents and purposes separate different areas of the cover 100. They simply enable the differentiated handling of specific areas of borders 104, 105 and 106 during assembly to be revealed in the specification.

The front area 109 of each of the first lateral borders 104 of a piece 102 and 103 has no characteristic. It is simply stitched with the front area 109 corresponding to the other piece 103 or 102, between the meeting point with the front border 107 and that with the dashed-dotted line 110.

The rear area 111 of each of the first lateral borders 104 ranges from this latter meeting point to the point located at the angle formed between this first lateral border 104 and the intermediate border 105 which is contiguous to it.

The intermediate borders 105 of the pieces 102 and 103 determine the end of an area delimited moreover in FIG. 1 by the dashed-dotted line 112.

The front area 113 of each of the second lateral borders 106 is in substance perpendicular to the corresponding intermediate border 105, and has in substance the same length.

This front area 113 ranges from on the one hand the meeting point between the intermediate border 105 and on the other hand the meeting point between the second lateral border 106 and the dashed-dotted line 114.

Lastly, the rear area 115 of each of the second lateral borders 106 extends from this latter meeting point to the meeting point between the second lateral border 106 and the rear border 108 which is contiguous to it. Each of the rear areas 115 has in substance the same length as each of the rear areas 111.

Figure 3:
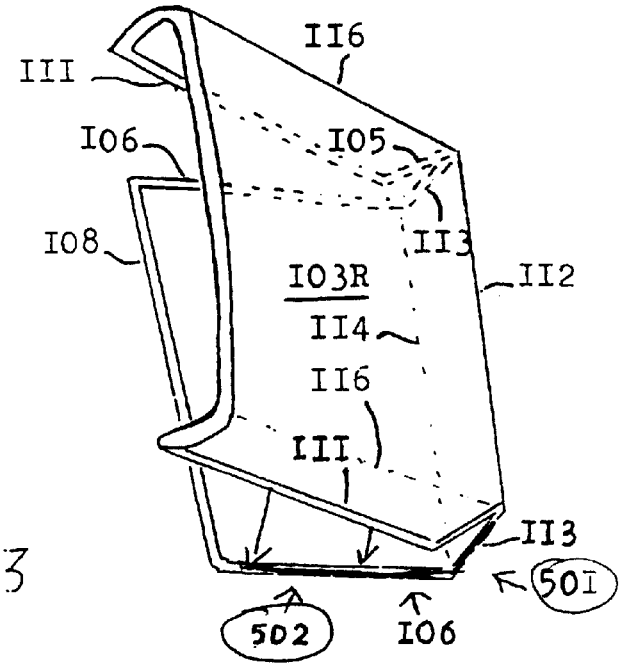
FIG. 3 illustrates a method for implementing a reversible holding device for a cover for a bedding element according to the invention.

The implementation of a first embodiment of a holding device 500 according to the invention is specified above both with reference to FIGS. 1 and 2 and with reference to FIG. 3, which only illustrates an holding device 500.

This holding device 500 may be implemented from a pattern comprising, on the one hand, the rearmost part of the piece 102, such as delimited between the dotted line 110 and the rear border 108, and on the other hand, the part corresponding to the piece 103. It is the side 103R which is turned toward the outside of the device 500. In order not to multiply the figures, such a pattern has nevertheless not been represented.

The implementation of a holding device 500 according to the invention is illustrated in FIG. 3.

Each of the borders 104, 105, and 106 of a piece 102 or 103 has to be superposed with the corresponding border of the other piece 103 or 102, and assembled with it, for example by stitching.

The front area 113 of each second lateral border 106 is assembled with a corresponding intermediate border 105, which was in substance perpendicular prior to assembly, and has in substance the same length. This way, a first assembly area 501, with dimensions equal to or slightly greater than that of the thickness of the mattress onto which it is desired to secure the cover, is formed on each side of the holding device 500—and therefore on each side of the cover 100.

Once an assembly area 501 is finished, the rear area 115 of each corresponding second lateral border 106 can be assembled with the rear area 111 of the corresponding first lateral border 104, which has in substance the same length. In that manner a second assembly area 502 is created on each side of the holding device 500.

It has been ascertained that the implementation of the holding device 500 produces folding lines 116. When a cover 100 is placed on a mattress 1, as represented in FIG. 2, these folding lines 116, as well as the line 112 superpose roughly on the upper edges 4 of the mattress 1. The outermost areas of the cover 100 perfectly overlay the thickness 5 at the foot 2. The line 114 superposes on the lower border (not visible in FIG. 2) located at the foot of the mattress 1. Thus, the holding device 500 closely conforms in shape to the foot 2 over the entire length of the second assembly area 502. The comforter 101 provided with its cover 100 is therefore perfectly held in place at the foot 2. Furthermore, the holding device 500 according to the invention ensures a proper holding of the cover 100 and of the comforter 101 over the entire length of the bedclothes.

The length of the assembly area 502 is usually of the order of forty centimeters. It is however to be understood that it may be greater or less in function of requirements, certain sleepers preferring more freedom of movement, and others being more susceptible to cold.

Even though a holding device 500 is illustrated obtained by stitching the elements 105 and 113 in order to form the first assembly area 501 and by stitching the elements 115 and 111 in order to form the second assembly area 502, we will not depart from the scope of the invention by utilizing other assembly modes in order to obtain a holding device which in substance takes on the form of a rectangle parallelepiped open on one of its sides, and suitable for conforming in shape to the form of the mattress. Thus, the assembled elements can be joined together by other assembly modes than stitching. They can be borders or parts of borders of pieces of fabric, as has been illustrated. They can also consist of folds, or be a combination of borders and folds.

The assembly areas need not necessarily be such that they can by superposed on the edges of a mattress. They can for example have an oblique disposition in relation to these edges or any other configuration suitable for obtaining a holding device according to the invention.

As mentioned above, the cover 100 represented in FIGS. 1 and 2 is completely reversible. The user can change the decoration of the bedding and be in contact with fresh and clean fabric without having to wash the cover too soon. Impeccable bedding will immediately be found because the cover is perfectly secured to the mattress in an instant. From the aesthetic point of view, the cover 100 is provided in order to exhibit an appearance both perfect in its reversed form and in its original form.

The cover 100 is advantageously provided with reversible flaps 117, which are stitched in the front area 109, near the front borders 107. They can be provided with detachable attachment means such as Velcro(r) and be closed up on themselves in order to form a loop suitable for being attached to a mattress slat, in order to ensure a maximum holding during sleep. These flaps 117 are particularly interesting for restless children or people susceptible to cold.

Preferably, the front borders 107 of the pieces 102 and 103 are stitched to each other; the rear borders 108 are then simply hemmed and left free one in relation to the other, in order to enable the insertion of a comforter 101 into the resulting compartment. Alternatively, they can be provided with detachable attachment means such as defined above.

In case of need, the front borders 107 can also not be stitched, but attached to each other by such detachable attachment means. A comforter 101 can then be inserted through the top of the cover 100 between the front borders 107. In such a case, the rear borders 108 can be joined together, by stitching or by detachable attachment means, or even be free.

As can be seen in FIG. 2, the rear borders 108 are destined to be tucked under the foot 2 of the mattress 1. When the cover 100 provided with its comforter 101 is in place, this is held in place on the bed, and furthermore tucked in such manner that it can in no case come out of the cover 100 through the opening provided between the rear borders 108 without manipulation to this end. The impeccable appearance of the bed is guaranteed. Even during utilization, the cover 100 moves very little, and is hardly likely to come loose at the foot 2.

In the case of an opening provided between the front borders 107, a comforter 101 can be added or removed more rapidly, without having to strip the whole bed.

The pattern of a cover 100 according to the invention can also comprise an intermediate piece of fabric (not represented in FIGS. 1 and 2), which, during assembly, can be stitched between the piece 102 and the piece 103. This intermediate piece then has similar dimensions to those of the parts of the pieces 102 and 103 which are defined by the borders 104, 105 and 107. The joining of the intermediate piece to the pieces 102 and 103 can for example be implemented by simply stitching the borders 104, 105 and 107 between them as already described and by intercalating the corresponding borders (not numbered) of the intermediate piece between the aforesaid borders.

This very simple and very effective arrangement enables the space enclosed between the sides 102V and 103V to be separated into two distinct small enclosures or compartments which are able to receive respectively the comforter 101 and a second comforter not represented in FIGS. 1 and 2. In that manner, a proper individual holding of each comforter in the cover 100, and the holding of one in relation to the other of the two superposed comforters in the cover 100 are ensured. The comforters do not have a tendency to slide one on top of another, which is not only an advantage in itself but contributes to the proper remaining in position of the cover 100 on the bed. It is not necessary that the two comforters are made to form one piece with each other.

If desired, it is of course possible to utilize a cover 100 provided with such a piece of intermediate fabric with a single comforter placed as desired in one of the small enclosures. The utilization of the cover 100 according to the invention provided with such a piece of intermediate fabric enables a fast and easy adaptation of the bedding in function of the ambient temperature.

Such an advantageous characteristic of the invention implementing an intermediate piece is also illustrated in FIGS. 8, 9, 11 and 12, which represent a third embodiment of the invention.

FIGS. 4 through 7 relate to a cover 200 according to the invention, implemented according to a second embodiment, and provided with a holding device 500.

Figure 4:
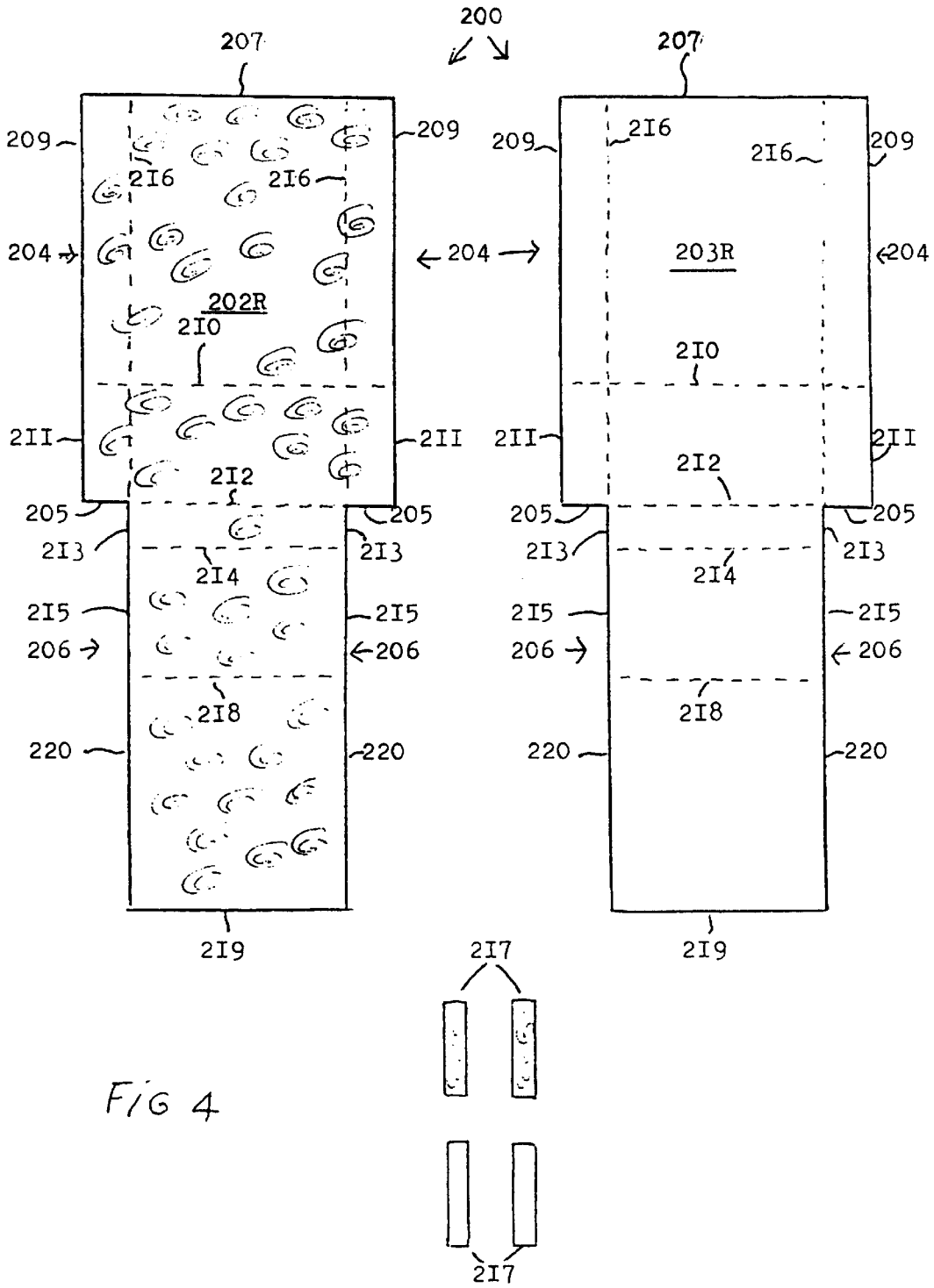
FIG. 4 represents a pattern consisting of different pieces of fabric utilized for implementing a second embodiment of a reversible cover for a bedding element according to the invention.

The pattern illustrated in FIG. 4 is similar to the pattern of the cover 100 described with reference to FIGS. 1 through 3 with respect to its front part. The elements 202 through 207 and 209 through 217 of the cover 200 are identical to the elements 102 through 107 and 109 through 117 of the cover 100. The area 215 of each of the second lateral borders 206 is indicated by the name of the middle area 215. There is however no element with the reference FIG. 208.

Indeed, even though the pattern of the cover 100 ends at its rear part by rear borders 108, the pieces 202 and 203 of the cover 200 extend from the line 218 represented in dashed-dotted lines (which is in substance at the same level as the rear borders 108 of the cover 100), to the rear borders 219. A so-called rear area 220 extends over each of the second lateral borders 206 between a line 218 and a rear border 219.

Figure 5:
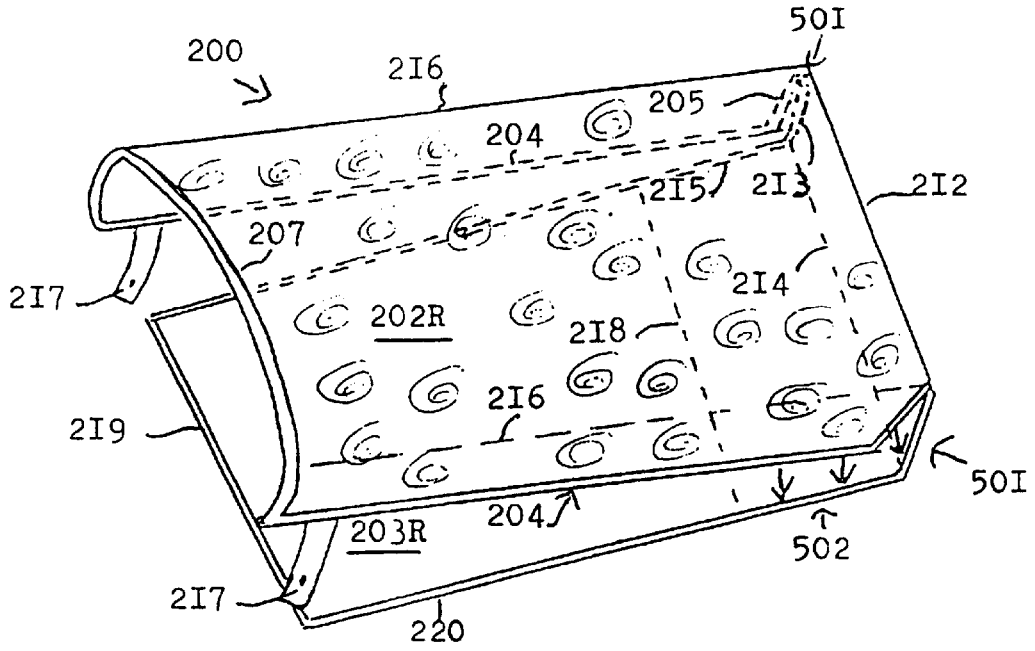
FIG. 5 is a view in perspective which represents this second embodiment of a reversible cover for a bedding element according to the invention, while being made.

FIG. 5 illustrates the implementation of a cover 200 according to the invention. The first piece of main fabric 202 and the second piece of main fabric 203 are joined to each other by their first lateral borders 204, their intermediate borders 205 and their second lateral borders 206. A holding device 500 is implemented in the manner described above by forming assembly areas 501 and 502. The rear areas 220 of the second lateral borders 206 of the two pieces 202 and 203 are stitched to each other two by two.

Figure 6:
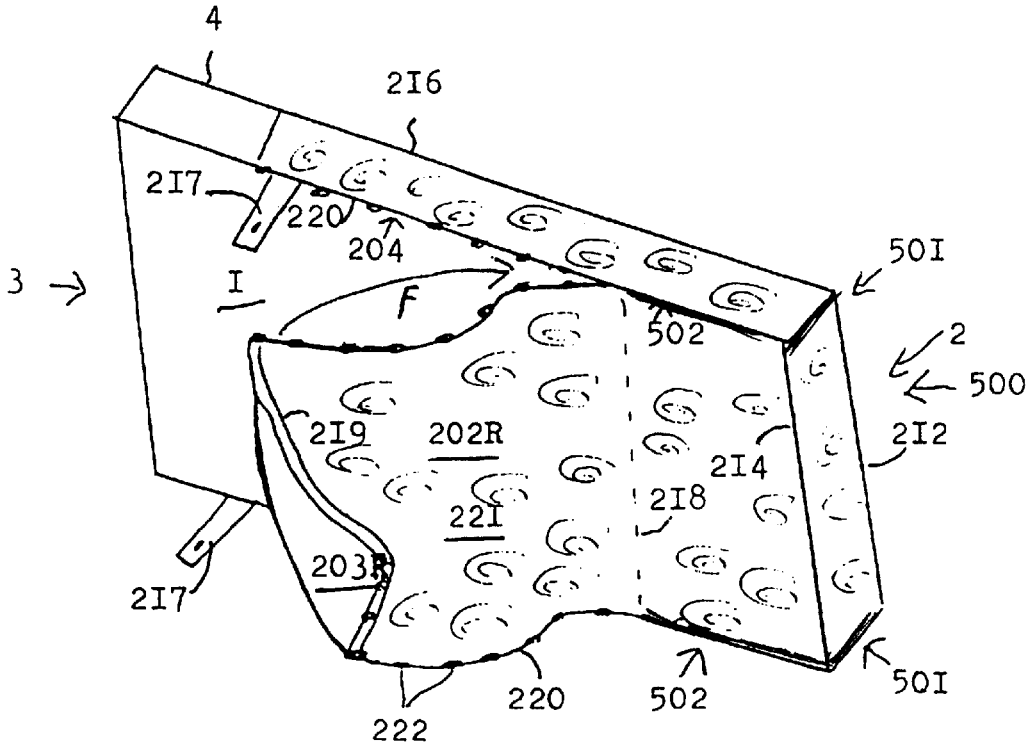
FIG. 6 is a view in isometric projection which illustrates a first implementation of this second embodiment of a reversible cover for a bedding element according to the invention, comprising a comforter and secured to a mattress.

FIG. 6 shows that the cover 200 can be utilized in a similar manner to the cover 100 and is therefore attached to the mattress 1 in the same way.

The piece of double fabric 221 delimited by the areas 220, the lines 218 and the rear borders 219 can be tucked under the mattress 1, preferably by fitting it under the holding device 500, according to the direction indicated by the arrow F in FIG. 6.

The rear borders 219 are also joined between them by the detachable attachment means.

The rear areas 220 of the second lateral borders 206 are stitched between them. In the same way, the front areas 209 of the first lateral borders 204 are stitched between them. The seams obtained are provided with detachable attachment means 222, in this case press studs, well visible in FIGS. 6 and 7.

The front borders 207 are preferably joined by detachable attachment means (for example Velcro(r)), in order to enable the insertion of a comforter 201 between the reverse sides 202V and 203V of the assembled pieces 202 and 203.

The comforter 201 can either be inserted preferably between the borders 207, or furthermore between the borders 219.

Figure 7:
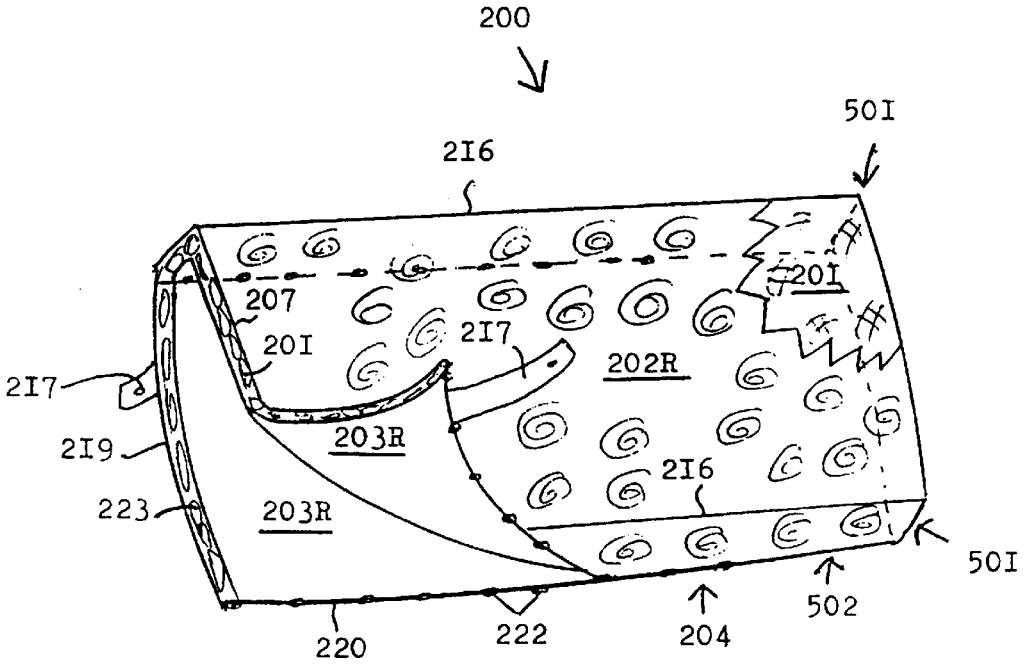
FIG. 7 is a view in isometric projection with partial cut-aways which illustrate a second implementation of this second embodiment of a reversible cover for a bedding element according to the invention comprising two comforters, and utilized in the absence of a mattress.

If desired, in an original manner the cover 200 according to the invention can be utilized as a sleeping-bag, as is illustrated in FIG. 7.

It is indeed sufficient to remove the cover 200 and its first comforter 201 from the mattress to which the cover is secured, to insert a second comforter 223 through the opening provided between the rear borders 219, which are then made to form one pieces again, and to attach to each other the seams of the areas 209 and 220 by detachable attachment means 222. In that manner a sleeping-bag is obtained provided with a washable and reversible cover 200. The detachable attachment means must be such that they ensure the holding of the sleeping-bag in closed position during sleep.

Such a sleeping-bag does not comprise elements that are hurtful and disagreeable to touch such as zip fasteners. It is comfortable and, owing to the holding device 500, enables the sleeper to have a great freedom of movement while being well protected during sleep.

It can at any time, and in an instant, be retransformed into a classic comforter cover, which can be perfectly secured to a bed by is holding device 500.

Even though not represented in the figures, the bedding element according to the invention can still be utilized in another manner. It is sufficient to replace the comforter 223 by a thin foam mattress or by an inflatable mattress. In that manner, an auxiliary, light, complete, hygienic and comfortable bedding material is obtained.

FIGS. 8 through 13 illustrate a third embodiment of a cover 300 according to the invention.

Figure 11:
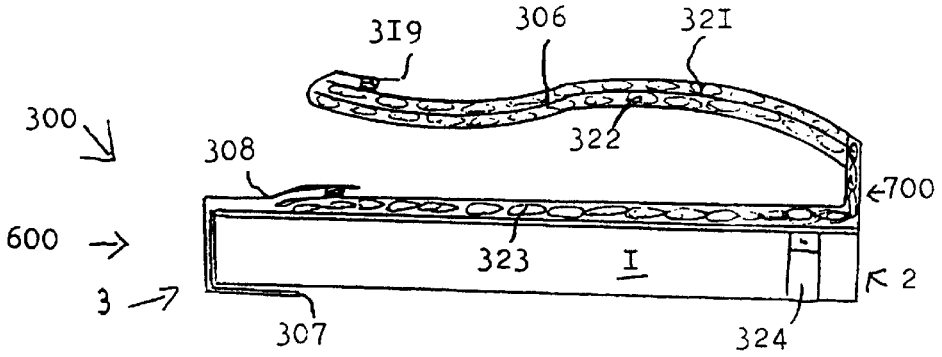
FIG. 11 is a cross-sectional view of this third embodiment of a cover for a bedding element according to the invention utilized on a mattress to the head of which it is secured.

The cover 300 according to the invention is provided with a holding device 600 which is suitable for being adapted to the head 3 of a mattress 1, as represented in FIG. 11.

The pattern comprises six pieces of fabric 301 through 306 which are joined in order to form the cover 300.

The piece 301 is moved and placed in a manner that it overlaps the piece 303, in a manner that the rear border 307 of the piece 303 is overlayed by the line 308 of the piece 301.

Figure 10:
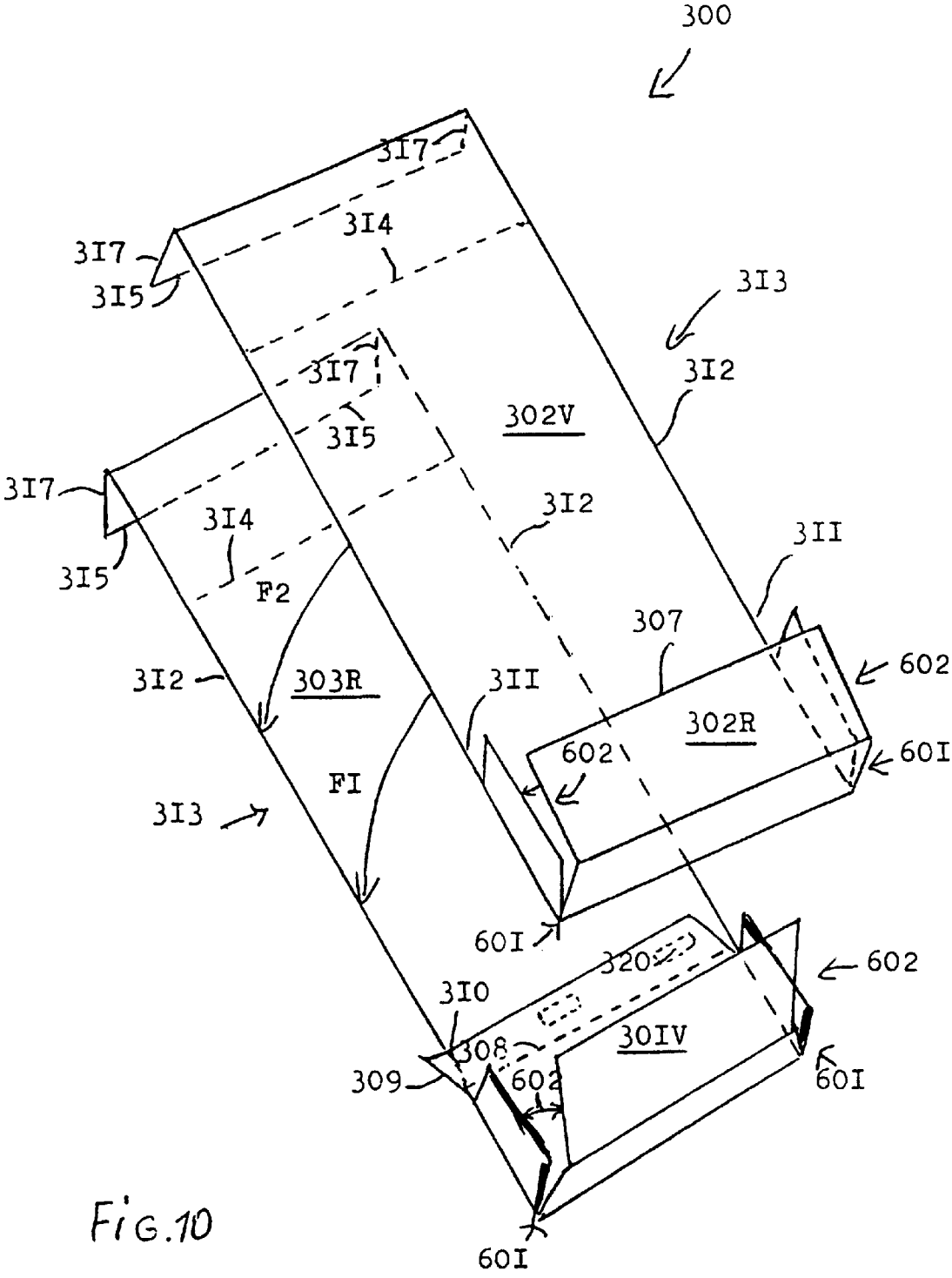
FIG. 10 illustrates a detail of a stage in the implementing of this third embodiment.

The piece 302 is then turned over onto its back as can be well seen in FIG. 10, and is stitched so that the area 309 of the piece 301, the area 310 of the piece 303 and the area 311 of the piece 302 are, on each side of the cover 300, joined in a single seam, as indicated by the arrow F1 from FIG. 10.

In a similar manner, the parts 312 of the lateral borders 313 of the pieces 302 and 303 are joined to each other as indicated by the arrow F2 in FIG. 10. The seam is implemented up to the intersection of the lateral borders 313 with the lines 314.

Clearly, similar seams are implemented on the other side.

The pieces 301, 302, and 303 which have been thus joined together form the lower part of the cover 300 (including the holding device 600). This will be joined to the three other pieces 304, 305 and 306.

These pieces 304 through 306 are superposed one on top of another with their borders 315 which coincide. They are joined at the borders 315 of the pieces 302 and 303.

It will be noted that the cover 300 comprises, at its part destined to be turned toward the foot 2 of the mattress 1, a structure 700 which is not provided in order to be secured thereto. This structure 700 is reminiscent of that of the holding devices 500 of the covers 100 and 200 according to the two first embodiments. It indeed comprises a first assembly area 701 and a second assembly area 702 which are similar to areas 501 and 502. Thus, the bottom of the cover 300 has in substance the form of an open rectangle parallelepiped, which guarantees the freedom of movement of the sleeper. The formation of the areas 701 and 702 on the basis of the areas 316 and 317 of the pieces 302 through 306 is illustrated in FIG. 9.

The pieces 304, 305 and 306 are joined together by their lateral borders 318 in a manner similar to that provided for the implementation of the covers 100 and 200. The upper part of the cover 300 ends by the upper border 319 of the piece 304, which is folded over onto the top of the cover 300.

Figure 9:
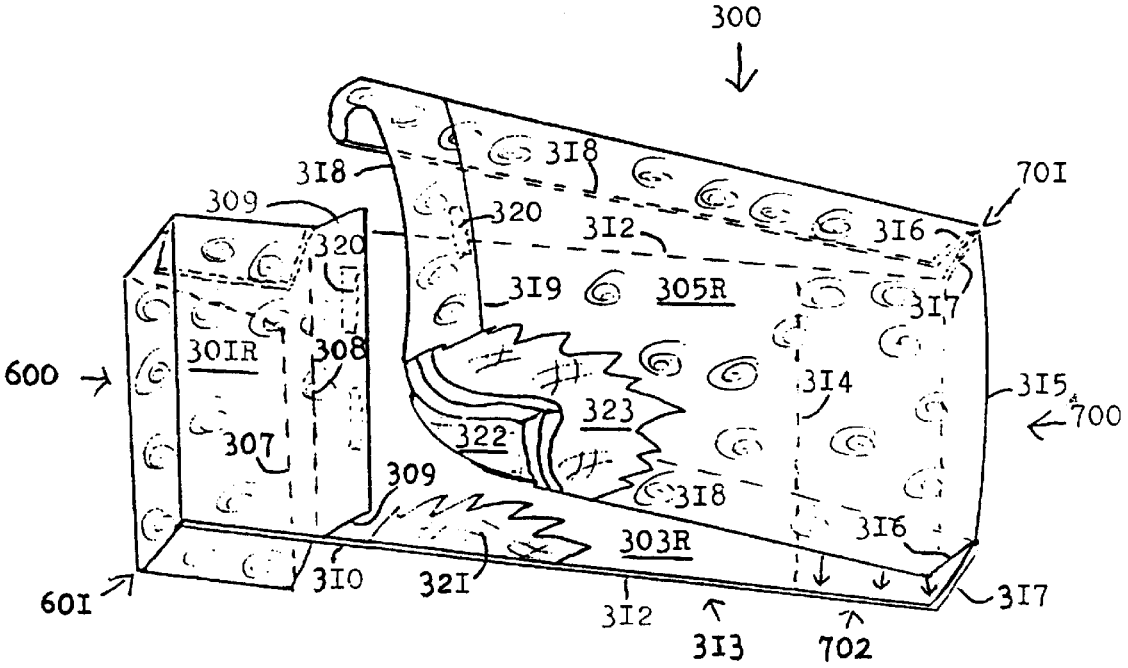
FIG. 9 illustrates this third embodiment while being made.
Figure 8:
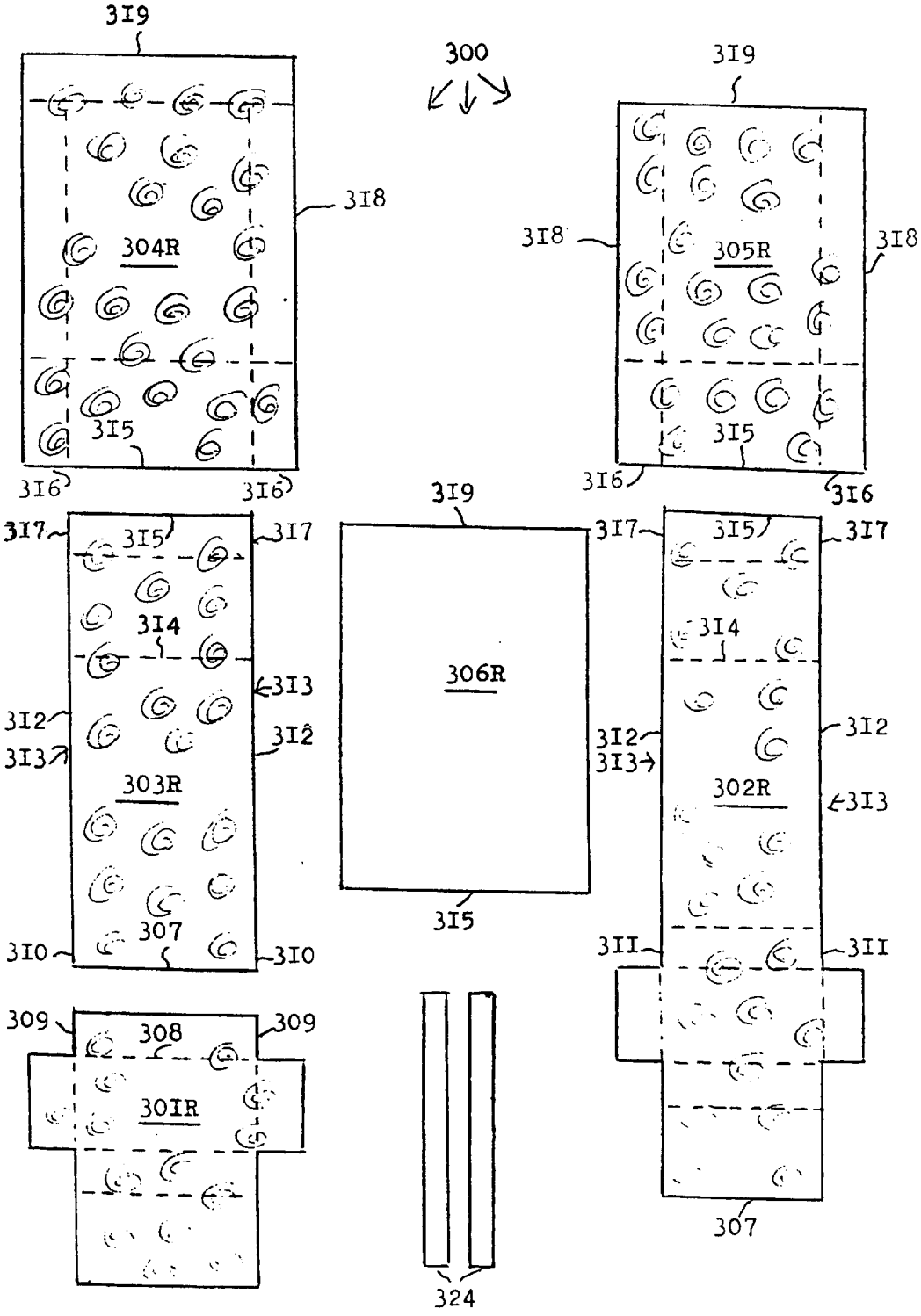
FIG. 8 represents a pattern consisting of different pieces of fabric utilized for implementing a third embodiment of a cover for a bedding element according to the invention.

The holding device 600 comprises assembly areas 601 and 602 analogous to the areas 501 and 502 of the holding devices 500 already described (see FIG. 9).

Pieces of Velcro 320 are provided in different appropriate locations illustrated in FIGS. 8, 9, 10 and 11.

The piece 306 is an intermediate piece which is joined between the pieces 304 and 305. It advantageously enables the insertion into the upper part of the cover 300 of two comforters 321 and 322 which remain correctly held in place and are not liable to slide one in relation to the other.

The cover 300 according to the invention can also, if desired, be provided with three comforters 321, 322, and 323 in order to obtain a comfortable sleeping-bag whose cover can be completely removed, which can be utilized on a mattress 1, as illustrated in FIG. 11. In this case, the holding device 600 is secured to the head 3 of this mattress 1. The sleeper has a great freedom of movement for the feet and warmth, and the holding in the correct position on the mattress during sleep is guaranteed. A double band of fabric 324 attached to the lower part of the cover 300 by appropriate means contributes toward ensuring that it is held fast by encircling the mattress 1 at its lower part.

Figure 12:
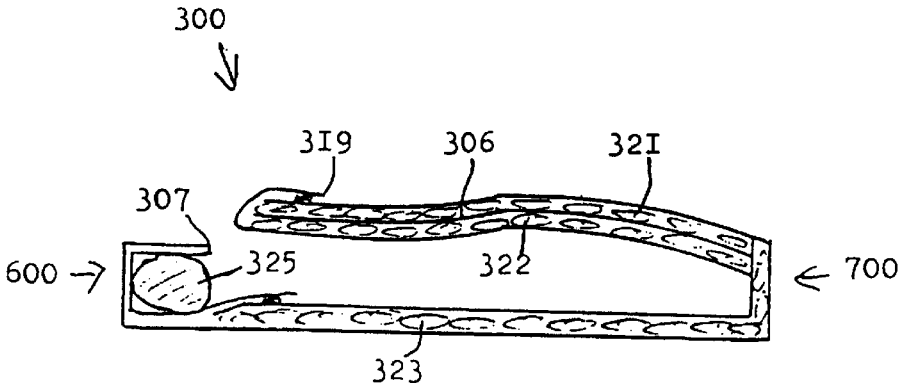
FIG. 12 is a cross-sectional view of this third embodiment of a cover for a bedding element according to the invention utilized without mattress.
Figure 13:
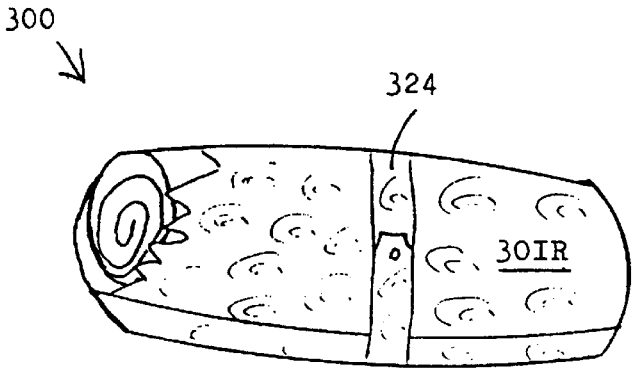
FIG. 13 is a general view with a partial cut-away of this third embodiment of a cover for a bedding element according to the invention, in a practical position for its transportation.

If the cover 300 is not secured to a mattress, the holding device 600 can be turned inside out in such a manner as to form an envelope for a pillow 325 as represented in FIG. 12.

If it is desired to carry along in a practical manner the sleeping-bag comprising the cover 300 according to the invention, it is sufficient to roll it up into the holding device 600 and to hold it closed with the band 324.

Even though that is not illustrated, the bedding elements according to the invention can also advantageously be utilized as bedspreads. It is sufficient for that to add flounces along the folding lines 116.

Implemented variants which are not explicitly specified will not depart from the scope of the invention. Thus for example, in each pattern, it can be decided whether or not to utilize an intermediate piece for separating the comforters.

Lastly, it should be emphasized that, even though particular patterns are illustrated, the covers, bedding elements and holding devices according to the invention can be obtained by following other patterns.

What is claimed is:

1. A cover for a bedding element suitable for receiving at least one comforter, said cover comprising a first main piece of fabric having an external face and an internal face and having lateral borders defining a rectangular segment and at one end thereof a narrower rectangular extension thereof including a free end and a second main piece of fabric having an internal face and an external face, lateral borders and the same size and shape of said first main piece of fabric, said first and second pieces of fabric being joined together at their lateral borders and at one end thereof but being left unjoined at the free end of the narrower extensions, said fabric being so joined together that their external faces are outwardly exposed and their inner surfaces are positioned back-to-back, said narrower extensions being folded back and joined at their lateral borders to the adjacent lateral borders of said rectangular segments so as to provide flaps extending along the lateral borders of said segments to maintain a comforter in position, said narrower extensions as joined to the rectangular segments also defining a compartment or holding device in the form of a rectangular parallelpiped open at one of its sides towards said rectangular segments and suitable for conforming in shape to an extremity of a mattress, said compartment or holding device being formed by joining the narrower extensions to said lateral borders in such a way that the cover is reversible so that the interior of the cover can become the exterior thereof.

2. A cover according to claim 1 characterized in that the fabrics are joined together by stitching.

3. A cover according to claim 1, characterized in that it comprises at least two compartments each suitable for receiving a comforter.

4. A cover according to claim 1, characterized in that it comprises at least three compartments each suitable for receiving a comforter.

5. A cover according to claim 1 comprising at least one intermediate piece of fabric placed between the two main pieces of fabric, this intermediate piece having dimensions such that it is suitable for being superposed on the two other pieces by defining with them two compartments each suitable for receiving a comforter.

6. A cover according to claim 1 comprising elements suitable for enabling their attachment to a mattress.

* * * * *